United States Patent [19]

Fröhlich et al.

[11] 4,348,302

[45] Sep. 7, 1982

[54] ANTICORROSIVE AGENT STABLE TO HARD WATER

[75] Inventors: Horst Fröhlich, Eppstein; Rainer Helwerth, Eschborn, both of Fed. Rep. of Germany

[73] Assignee: Hoechst Aktiengesellschaft, Fed. Rep. of Germany

[21] Appl. No.: 191,677

[22] Filed: Sep. 29, 1980

[30] Foreign Application Priority Data

Oct. 4, 1979 [DE] Fed. Rep. of Germany ..... 2940258

[51] Int. Cl.[3] ..... C23F 11/14; C23F 11/12; C07C 79/40

[52] U.S. Cl. ..... 252/389 R; 252/392; 252/394; 260/404; 562/499; 562/553

[58] Field of Search ..... 252/389 R, 392, 394; 260/404; 562/499, 553

[56] References Cited

U.S. PATENT DOCUMENTS 3,779,935 12/1973 McDougall et al. ..... 252/392
3,857,950 12/1974 Choay ..... 562/553

*Primary Examiner*—Irwin Gluck
*Attorney, Agent, or Firm*—Connolly and Hutz

[57] ABSTRACT

Anticorrosive agent stable to hard water, which comprises an alkali metal salt, alkaline earth metal salt, or amine salt of a compound of the formula

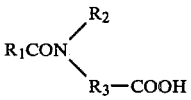

in which $R_1$ is branched $C_6$–$C_{13}$-alkyl or $C_5$- or $C_6$-cycloalkyl, or polycycloalkyl having from 6 to 13 carbon atoms optionally substituted by 1 or 2 $C_1$–$C_4$-alkyl groups, $R_2$ is hydrogen or $C_1$–$C_6$-alkyl, and $R_3$ is $C_1$–$C_{11}$-alkylene in linear or branched chain.

2 Claims, No Drawings

ANTICORROSIVE AGENT STABLE TO HARD WATER

All over the field of metal processing and metal surface treatment, and in cooling cycles it is normal to use more or less strongly alkaline aqueous solutions containing corrosion-inhibiting additives for ferrous and nonferrous metals in order to prevent undesirable corrosion. This is valid for example for such widespread processes as cutting and non-cutting metal shaping, cleaning of metal surfaces, or inner protection of streaming aqueous systems.

Inorganic salts such as sodium nitrite or chromates, for example, are well known and widespread corrosion-inhibiting additives; toxicological and ecological reasons, however, forbid their further use in these fields.

Recently, therefore, organic inhibitor systems are increasingly used which do not have these disadvantages. Thus, for example, in German Pat. No. 1,298,672 alkylaryl-sulfonamidocarboxylic acids or the salts thereof are proposed for this application. Furthermore known is the use of alkylsubstituted benzoic acids. These substances, however have serious disadvantages, too. Salts of alkyl-substituted benzoic acids, for example, are highly sensitive to hard water, which drawback hinders their application in cutting liquids free from mineral oil. Similar negative properties, although less pronounced, are observed in alkanolamine salts of the cited alkylaryl-sulfonamidocarboxylic acids. In these cases, on prolonged service life of the functional liquids scarcely soluble calcium and magnesium salts precipitate due to evaporation losses of pure water and corresponding hardening of the solution, so that crystalline deposits are formed on the machines, and the solution is exhausted with respect to active substances.

It is furthermore known to use acylated aminocarboxylic acid salts as anticorrosives, where the acyl radical is derived from long-chain fatty acids. However, these products have proved to be very disadvantageous in the practice, because they foam heavily.

Subject of the present invention are water-miscible anticorrosives stable to hard water having improved properties, which substantially consist of an alkali metal salt, alkaline earth metal salt, or amine salt of a compound of the formula

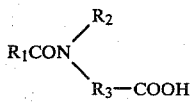

in which $R_1$ is branched $C_6$–$C_{13}$-alkyl or $C_5$- or $C_6$-cycloalkyl, or polycycloalkyl having from 6 to 13 carbon atoms optionally substituted by 1 or 2 $C_1$–$C_4$-alkyl groups, $R_2$ is hydrogen or $C_1$–$C_6$-alkyl, and $R_3$ is $C_1$–$C_{11}$-alkylene in linear or branched chain.

As bases being suitable for neutralizing the above carboxylic acids, there may be used alkali metal hydroxides, alkali metal carbonates or the corresponding alkaline earth compounds, for example sodium hydroxide, sodium carbonate, potassium hydroxide or barium hydroxide. Further suitable bases are alternatively organic amines such as triethanolamine, diethanolamine, tri-isopropanolamine, mono-, di- or triethylamine, mono-isopropylamine, mono-2'-ethylcyclohexylamine, mono-i-nonyl-amine, 2-methyl-2'-aminopropanol, cyclohexylamine-N,N'-dimethylcyclohexylamine, N-hexylamine, N-octylamine, tri-isobutylamine, di-N-hexylamine, ethylene diamine, diethylene triamine, piperidine, piperazine or morpholine. For salt formation, the acids and the base can be used in stoichiometric amounts, or only one of the components may be used in excess.

The anticorrosives of the invention may be used per se or in admixture with known metal processing liquids or aqueous oil emulsions, and they can be applied in the form of aqueous solutions, dispersions or emulsions. The application concentration of the anticorrosives of the invention depends on the special application of the liquid with which the ferrous and non-ferrous metals are contacted. Generally, it is from 0.5 to 10, preferably 2 to 5, % by weight.

For the intended effect of the anticorrosives of the invention it is essential that the alkyl group $R_1$ of the above formula is branched. The corresponding acids are obtained in known manner by reaction of aminocarboxylic acids with carboxylic acid chlorides in the presence of alkali according to a Schotten-Baumann reaction. The aminocarboxylic acids are for example obtained by hydrolysis of lactams such as ε-caprolactam or γ-butyrolactam, or by addition of primary amines onto acrylic, methacrylic or crotonic esters or nitriles, and subsequent saponification. Examples of aminocarboxylic acids are Ω-amino-undecanoic, ε-aminocaproic, γ-aminobutyric, β-alanine-glycine-N-n-butyl-β-aminopropionic, N-i-propyl-β-aminopropionic, N-cyclohexyl-β-aminopropionic, N-cyclohexyl-alpha-methyl-β-aminopropionic, or N-cyclohexyl-β-methyl-β-aminopropionic acid. Examples of acid chlorides are pivalic acid chloride, 2-ethyl-hexanoic acid chloride, isononanoic acid chloride, bicycloheptenic acid chloride, tricyclodecanoic acid chloride, naphthenic acid chloride or neodecanoic acid chloride. Preferred are isononanoic acid chloride, 2-ethylhexanoic acid chloride and neodecanoic acid chloride.

The salts of the above carboxylic acids have an excellent anticorrosive action with respect to iron, and they have an extremely low tendency to foaming, which is very important for practical application. They are furthermore substantially insensitive to the hardness-forming substances of water, and even under extreme electrolyte strain conditions, they leave deposits after drying which are of low viscosity and of oily consistency, so that they are not tacky and can be easily dissolved either with the service solution or with fresh water.

The following Examples illustrate the invention.

EXAMPLE 1

2-Ethylhexanoyl-ε-aminocaproic acid 113 g (1.0 mol) of ε-caprolactam are dissolved in 200 ml of water, and refluxed for 4 hours with 120 g (1.0 mol) of 33% sodium hydroxide solution. The batch is cooled to 20° C., and 158.4 g (0.975 mol) of 2-ethylhexanoic acid chloride as well as simultaneously about 120 g of 33% sodium hydroxide solution (for maintaining a pH of 12) are added dropwise within 1 hour at 20°–25° C. The solution is further stirred until no sodium hydroxide solution is consumed any longer, and subsequently acidified at 50° C. with semiconcentrated hydrochloric acid in order to obtain a pH of 1. Separation is carried out in warm state, and the acid is washed with 350 ml of water. Subsequently, it is dehydrated in a rotation evaporator at 75° C./100 mm Hg, and separated as nearly colorless viscous oil, which solidifies to crystals after some time. Yield 233 g (93%). Acid number 225, water content 0.4%.

EXAMPLE 2

Mixture of 2-ethylhexanoyl-ε-aminocaproic acid and isononanyl-ε-aminocaproic acid 113 g (1 mol) of ε-caprolactam are hydrolyzed as described in Example 1, and subsequently reacted according to Example 1 with a mixture of 79.6 g (0.49 mol) of 2-ethylhexanoic acid chloride and 86.5 g (0.49 mol) of isononanoic acid chloride which can be prepared separately or from an equimolar mixture of 3-ethylhexanoic acid and isononanoic acid, in known manner. 238.6 g (90.4%) of a nearly colorless oil, acid number 216, are obtained.

EXAMPLE 3

Tricyclodecanoyl-ε-aminocaproic acid

According to Example 1, 113 g (1 mol) of ε-caprolactam are hydrolyzed and reacted with 181.7 g (0.91 mol) of tricyclodecanoic acid chloride. The above acid is obtained as yellow, highly viscous oil with a yield of 236.1 g (88.5%), having an acid number of 194.

EXAMPLE 4

Isononanoyl-ε-aminocaproic acid

According to Example 1, 113 g (1 mol) of ε-caprolactam are hydrolyzed and reacted with 172 g (0.975 mol) of isononanoic acid chloride. Work-up yields 257.5 g (95%) of a nearly colorless viscous oil which solidifies to crystals after some time. Acid number 210.

For preparing an aqueous anticorrosive, 35 g each of the acids of Examples 1 to 4 were mixed with 50 g of triethanolamine and 15 g of water to give a clear, homogenous solution.

Deposit formation of the products obtained according to the Examples was tested in a long duration pump circulation test. The principle of this test method is the following: About 10 liters of an aqueous solution of the anticorrosive is pump-circulated at room temperature in large-volume open glass vessels in such a manner that deposits can be formed by splashing and vaporization. For this purpose, an electrically driven commercial laboratory pump having a conveying capacity of 10 l/min. is introduced into the solution, where it aspirates the solution via a hose duct of a diameter of 0.8 cm, conveys it above level height and forces it back to the surface of the bath content in a focused jet. The jet is let off at about 15 cm above the liquid level, and its angle of entry can be chosen as desired.

The intended deposits on those parts of the walls of the vessel which are not flushed are formed in two different ways. On the one hand, normal splashing ensures the necessary wetting, and on the other hand, the jet, on immersion into the liquid, constantly takes along a multitude of small air bubbles which, exploding again on the surface of the liquid, continuously spray a liquid film onto the walls of the vessel. This operation mode ensures simultaneously high evaporation rates even at room temperature which, at batches of 10 liters, are in the range of 1 liter per day. These losses are replaced by drinking water having 20 German hardness degrees (about 350 ppm), thus ensuring continuous hardening of the system. The corresponding increase of hardness-forming substances is calculated on the amounts added for refill.

Aqueous formulations having a content of 3% of active substance were used for the tests. As comparative formulations, the following products were employed:

| | | |
|---|---|---|
| Comparison A: | | |
| homogenous mixture of | 35% | of p-tert.-butylbenzoic acid |
| | 50% | of triethanolamine |
| | 15% | of water |
| Comparison B: | | |
| homogenous mixture of | 35% | of ε-(benzenesulfonylmethylamino)-n-caproic acid according to German Patent No. 1,298,672 |
| | 50% | of triethanolamine |
| | 15% | of water. |

The results of the tests are listed in the following Table.

TABLE

Deposit formation depending on test time and water hardness

| Test time (hrs.) | Hardness content (ppm) | Deposit Ex. 1 | Deposit Ex. 2 | Deposit Ex. 3 | Deposit Ex. 4 | Deposit Comp. A | Deposit Comp. B |
|---|---|---|---|---|---|---|---|
| 24 | 35 | clear/liquid | | clear/liquid | clear/liquid | clear/liquid | clear/liquid |
| 48 | 70 | " | | " | " | crystalline | " |
| 42 | 105 | " | | " | " | " | " |
| 96 | 140 | " | | " | " | | " |
| 120 | 175 | " | | " | " | | " |
| 144 | 210 | " | | " | " | | " |
| 168 | 245 | " | | " | " | | " |
| 192 | 280 | " | | " | " | crystalline | crystalline |
| 216 | 315 | " | | " | " | | |
| 24 | 385 | clear/liquid | clear/liquid | clear/liquid | clear/liquid | crystalline | clear/liquid |
| 48 | 420 | " | " | " | " | | " |
| 72 | 455 | " | " | " | " | | crystalline |
| 96 | 490 | " | " | " | " | | |
| 120 | 525 | " | " | " | " | | |
| 144 | 560 | " | " | crystalline | " | | |
| 168 | 595 | " | " | | " | | |
| 192 | 630 | " | " | | " | | |
| 216 | 665 | " | " | | " | | |

We claim:

1. Anticorrosive agent stable to hard water, which comprises an alkali metal salt, alkaline earth metal salt, or amine salt of a compound of the formula

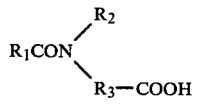

in which $R_1$ is branched $C_6$–$C_{13}$-alkyl or $C_5$- or $C_6$-cycloalkyl, or polycycloalkyl having from 6 to 13 carbon atoms optionally substituted by 1 or 2 $C_1$–$C_4$-alkyl groups, $R_2$ is hydrogen or $C_1$–$C_6$-alkyl, and $R_3$ is $C_1$–$C_{11}$-alkylene having a linear or branched chain.

2. Anticorrosive agent stable to hard water consisting substantially of a 0.5 to 10 weight % aqueous solution, dispersion or emulsion of the compound as claimed in claim 1.

* * * * *